United States Patent [19]

Neinast

[11] 4,113,236

[45] Sep. 12, 1978

[54] PULLING TOOL APPARATUS

[75] Inventor: Gary S. Neinast, Plano, Tex.

[73] Assignee: Suntech, Inc., St. Davids, Pa.

[21] Appl. No.: 714,208

[22] Filed: Aug. 23, 1976

[51] Int. Cl.[2] ..... E21B 43/00; B65H 59/00; E21C 29/16; H02G 1/08

[52] U.S. Cl. ..... 254/134.5; 15/104.05; 175/103; 175/104; 104/138 G

[58] Field of Search ..... 166/105; 175/97, 104; 254/134.5; 105/63, 64 R; 104/155; 15/104.05, 104.12, 104.3

[56] References Cited

U.S. PATENT DOCUMENTS 2,650,314 8/1953 Hennigh et al. ..... 175/97

3,036,530 5/1962 Mills et al. ..... 254/134.5

*Primary Examiner*—James A. Leppink

*Attorney, Agent, or Firm*—J. Edward Hess; Donald R. Johnson; Stanford M. Back

[57] ABSTRACT

A pulling tool apparatus for assisting equipment to descend down a wellbore, such as logging tools being lowered into a deviated wellbore. The pulling tool includes a pump located in the tool housing for pulling drilling mud into the lower end of the pulling tool and discharging the drilling mud in an upward direction so as to provide a downward force on the logging tool and logging cables. Several pulling tools can be used at the same time, each being spaced at intervals along the logging cable.

5 Claims, 4 Drawing Figures

PULLING TOOL APPARATUS

BACKGROUND OF THE INVENTION

This invention is related to tools for use inside a wellbore and more specifically to an apparatus for pulling a logging cable and logging device down into a deviated borehole.

When drilling from offshore drilling platforms, it is usually the established practice to drill outward from the tower in many different directions, so as to best utilize the platform. The result is that most of the wellbores do not go straight down but extend downward and outward at an angle from vertical. These deviated boreholes create different problems than those encountered in conventional onshore drilling operations. One problem encountered when trying to survey these boreholes, occurs when a logging tool is lowered down the borehole. Since the borehole is usually drilled at quite an angle, often up to seventy degrees from vertical, the force of gravity on a logging tool and logging cable is not sufficient to overcome the friction encountered by the tool and cable against the side of the borehole. Often, many man hours of work are lost in trying to force the logging tool to the bottom of the borehole. It is therefore desirable to have some type of a tool which will aid the logging tool in its descent down through the wellbore.

Several kinds of pulling devices have been tried in the past. However, none of these have proved to be effective. These designs include crawling and vibrating devices as well as attempts to use stiff cables or drilling mud to push the equipment down the borehole.

SUMMARY OF THE INVENTION

In accordance with a preferred embodiment, a pulling tool is disclosed which assists the logging tool and logging cable descend into a deviated borehole. The tool housing has an elongated shape with couplings on the lower and upper end for connection to the logging cable or logging tool. A pump is provided within the tool housing and a motor, which can operate off the electric power supplied to the logging tool through the logging cable, provides the driving force for the pump. Inlets are provided around the side wall at the lower end of the body for drilling mud to be sucked into the intake of the pump and discharged at the upper end of the body through outlets provided at the upper end and the side wall near the upper end of the body.

The types of pumps which can be used in the pulling tool include the auger, centrifugal, or positive displacement pumps. However, a preferred embodiment is provided which uses a progressing cavity pump having a rotor and a stator designed so that cavities are formed which progress from the inlet end of the pump to the discharge end of the pump such as that disclosed in U.S. Pat. No. 2,924,180. Pumps similar to this are produced by Robbins and Myers, Inc., and sold under the trademark "Moyno" pump.

Use of this pulling tool helps to overcome the force of friction on the logging tool and cables as they are lowered into a wellbore. The greater the angle (from vertical) becomes, the greater the friction force encountered and the more pulling tools which may be necessary. The power normally used by the logging equipment can be used by the pulling tools during descent and used to operate the logging equipment when the equipment is withdrawn from the wellbore.

A better understanding of this invention and its advantages can be seen in the following descriptions of the figures and preferred embodiment.

DESCRIPTION OF THE DRAWINGS AND PREFERRED EMBODIMENT

Figures 1, 2, 3, 4:
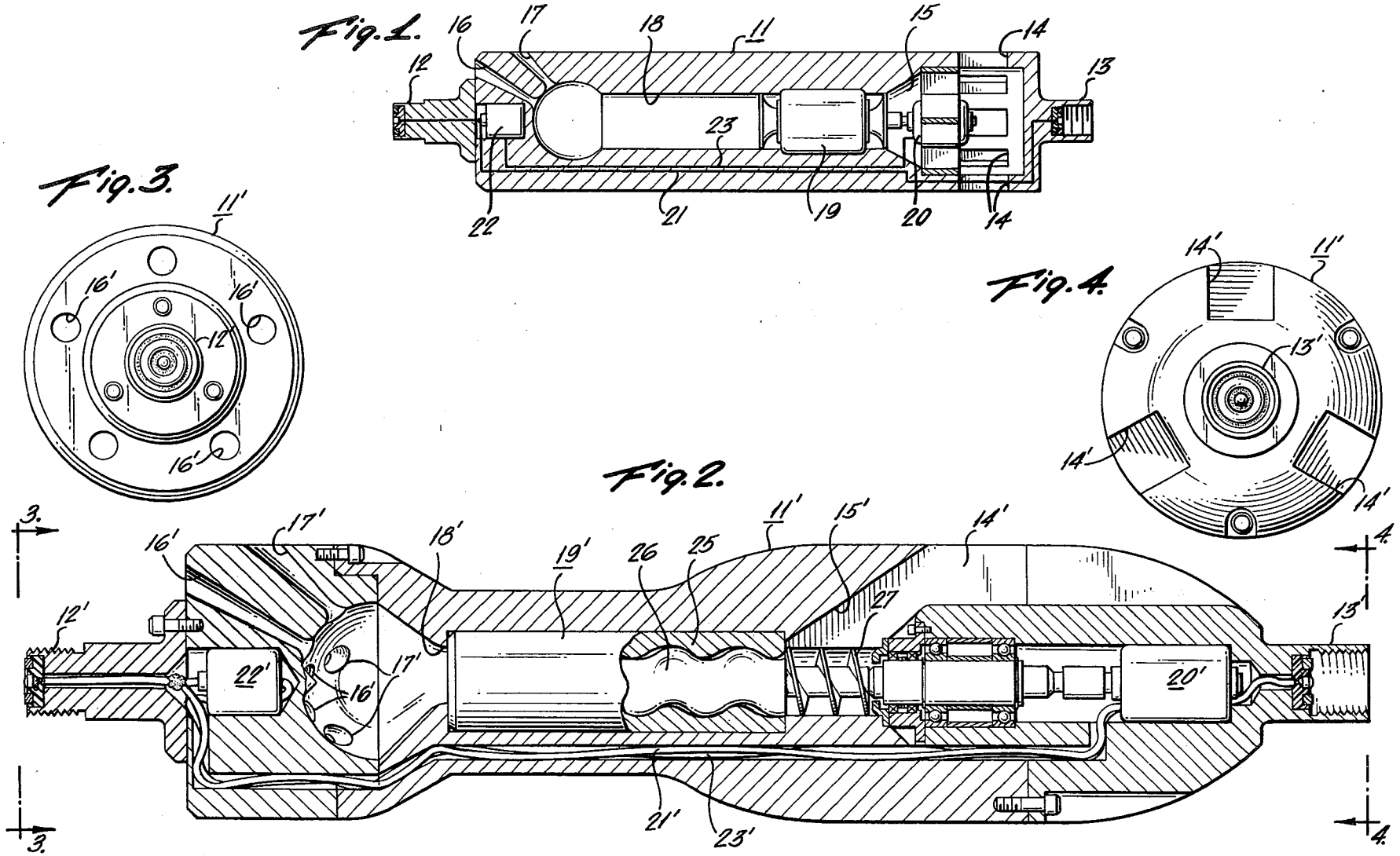
FIG. 1 is a sectional view of the pulling tool illustrated in schematic form.
FIG. 2 is a sectional view of the pulling tool shown in FIG. 1 with the installation of a Moyno pump.
FIG. 3 is a sectional view taken along the line 3—3 in FIG. 2.
FIG. 4 is a sectional view taken along the line 4—4 in FIG. 2.

The reference to FIG. 1, the basic embodiment of the pulling tool includes a pulling tool housing 11 having an elongated, cylindrical configuration, with couplings 12 and 13 on the upper and lower ends of the body 11, respectively. Included within couplings 12 and 13 are electrical terminals (not shown) for connecting the cable circuit through the pulling tool as well as for supplying power to the pulling tool. Pulling tool body 11 has a plurality of openings 14 spaced around the side wall of the body near the lower end thereof, for the purpose of providing an inlet for intake cavity 15. Discharge passageways are provided at the upper end of body 11 with passageways 16 spaced around the upper end of body 11 and passageways 17 spaced around the side wall at the upper end of body 11. Internal passageway 18 provides fluid communication between intake cavity 15 and discharge passageways 16 and 17.

For the purpose of propelling fluid from intake cavity 15, through internal passageway 18 and out discharge outlets 16 and 17, a pump 19 is provided which is driven by motor 20, both of which can be located within internal passageway 18. Motor 20 can be operated off the power supplied to the logging tool and connected to the power supply line 21 through a relay switching means 22 and line 23. Relay switching means 22 can be designed so that its position is controlled in response to a signal sent from the surface on a separate control cable (not shown) or in response to a multiplexed signal or other signals imposed on power supply line 21.

The particular type of pump 19 which can be used should be one which can operate reliably on drilling mud which contains finely dispersed particle matter. Pumps that could be easily modified to act on drilling mud are auger or helical pumps, centrifugal pumps, or positive displacement pumps. However, a preferred type of pump is that which is known as the "Moyno" pump, manufactured by Robbins and Myers, Inc., of Springfield, Ohio. This particular type of pump is shown in FIG. 2 and has a stator 25 and a rotor 26 which are designed to form cavities between each other which are gradually progressed from the intake end to the outlet end as the rotor is rotated. An auger stator 27 may be used to help the intake of drilling mud into the progressing cavity portion of the pump, as is shown in FIG. 2. The other aspects of this embodiment which remain similar to that shown in FIG. 1 bear the same identification numbers with prime designations.

In the operation of either embodiment of this pulling tool, several pulling tools can be connected at intervals along the logging cable. As the logging cable descends down the wellbore, motor 20 is switched on by sending the appropriate signal to relay 22. Drilling mud in the wellbore is then drawn into intake cavity 15, through inlet openings 14 by pump 19, and discharged through internal passageway 18 and discharge passageways 16 and 17. Discharge passageways 16 and 17 are preferably evenly spaced around the end of the pulling tool housing 11 and the side of the housing 11 so that the discharge of drilling mud through passageways 16 and 17 helps to maintain housing 11 in proper alignment within the wellbore. Additionally, the drilling mud flowing from discharge passageways 17 helps to maintain the pulling tool away from the side of the wellbore to minimize the effects of differential sticking.

While additional power can be supplied to the motor for driving the pump so that the logging operation can be conducted by the logging tool during the descent, an alternative manner of operation is to utilize the existing power system and switch off the logging tool during the descent operation and use the existing power to operate motor 20 until the logging tool reaches the bottom of the wellbore. At this time, pump motor 20 can be switched off and the power can be switched on to the logging tools so that the loggging process can take place while the tool is being withdrawn from the wellbore. This method of operation reduces the requirement of adding an additional power cable for operating the pump motors or for reducing the power available to the logging tool, and can be practiced by utilizing a relay switching system for each pulling tool similar to that disclosed above, and also a similar relay switching system for the logging tool or other instrument.

While a particular embodiment of this invention has been shown and described, it is obvious that changes and modifications can be made without departing from the true spirit and scope of the invention. It is the intention of the appended claims to cover all such changes and modifications.

The invention claimed is:

1. A pulling tool for use in a wellbore having fluid therein to pull a cable and associated apparatus through the wellbore, said tool comprising:

(a) an elongated housing having an internal fluid flowpath therein which includes,
  (i) an internal passageway,
  (ii) a fluid inlet at a first end, and
  (iii) a fluid outlet at the second end, so that fluid can flow through the fluid inlet, the internal passageway, and the fluid outlet; wherein said outlet comprises a plurality of discharge passageways extending from the internal passageway to the second end of the housing, said discharge passageways being angled rearwardly and sufficiently parallel to the wellbore to provide a thrust of fluid in a direction opposite to the direction of fluid flow through the internal fluid flowpath.

(b) means for connecting the housing to the cable to be pulled through the wellbore;

(c) means connected to said internal passageway for propelling the fluid in the wellbore through the internal fluid flowpath so that fluid is drawn in through the fluid inlet and expelled through the fluid outlet, thereby providing a force which pulls the cable and associated apparatus through the wellbore in a direction opposite to the direction of fluid flow through the internal fluid flowpath; and (d) means for driving the propelling means.

2. The pulling tool recited in claim 1, wherein the outlet also provides a plurality of additional discharge passageways extending from the internal passageway to the side of said housing at its second end, so that the discharge of fluid there through helps reduce the chance of differential sticking.

3. The pulling tool recited in claim 1 wherein the propelling means comprises a pump having a stator and a rotor which form cavities between each other which are displaced from the intake end toward the discharge end of said pump by the rotation of the rotor.

4. The pulling tool recited in claim 3, wherein the driving means operate off of electrical power supplied from the surface, and the pulling tool further comprises switching means, responsive to a signal from the surface, for selectively connecting the driving means to the power supplied from the surface, so that the operation of the propelling means can be remotely controlled.

5. The pulling tool recited in claim 1, wherein the driving means operates off of electrical power supplied from the surface, and the pulling tool further comprises switching means, responsive to a signal from the surface, for selectively connecting the driving means to the power supplied from the surface, so that the operation of the propelling means can be remotely controlled.

* * * * *